US008960784B1

(12) United States Patent
De Berry

(10) Patent No.: US 8,960,784 B1
(45) Date of Patent: Feb. 24, 2015

(54) INCLINED CHAIR ASSEMBLY

(71) Applicant: Roderick De Berry, Memphis, TN (US)

(72) Inventor: Roderick De Berry, Memphis, TN (US)

( * ) Notice: Subject to any disclaimer, the term of this patent is extended or adjusted under 35 U.S.C. 154(b) by 42 days.

(21) Appl. No.: 13/827,916

(22) Filed: Mar. 14, 2013

(51) Int. Cl.

| | |
|---|---|
| ***A47C 4/10*** | (2006.01) |
| ***A47C 4/12*** | (2006.01) |
| ***A47C 4/20*** | (2006.01) |
| ***A47C 4/22*** | (2006.01) |
| ***A47C 4/28*** | (2006.01) |
| ***A47C 4/42*** | (2006.01) |
| ***A47C 4/44*** | (2006.01) |
| ***A47C 4/46*** | (2006.01) |
| ***A47C 1/14*** | (2006.01) |
| ***A47C 4/00*** | (2006.01) |

(52) U.S. Cl.
CPC ..... *A47C 4/00* (2013.01)
USPC ..... 297/16.1; 297/19; 297/21; 297/22; 297/45; 297/51; 297/53; 297/58

(58) Field of Classification Search
CPC ..... A47C 15/004; A47C 7/008; A47C 7/62; A47C 4/286; A47C 3/38
USPC ..... 297/45, 344.18, 16.1, 19, 21, 22, 51, 297/53, 58
See application file for complete search history.

(56) References Cited

U.S. PATENT DOCUMENTS

| | | | | | |
|---|---|---|---|---|---|
| 595,450 | A * | 12/1897 | Archer | 297/423.19 |
| 2,905,513 | A * | 9/1959 | Kane | 108/128 |
| 2,978,012 | A * | 4/1961 | Norseen | 108/116 |
| 4,772,068 | A | 9/1988 | Gleckler et al. | |
| 5,364,163 | A * | 11/1994 | Hardison | 297/344.21 |
| 5,494,333 | A * | 2/1996 | Wilson | 297/344.18 |
| 5,522,642 | A * | 6/1996 | Herzog | 297/344.18 |
| 6,036,148 | A | 3/2000 | Shank | |
| 6,056,353 | A | 5/2000 | Meara | |
| 6,095,607 | A | 8/2000 | Wenzel | |
| 6,820,928 | B1 * | 11/2004 | Ransom | 297/51 X |
| 6,871,911 | B2 | 3/2005 | Alexander, Jr. | |
| 6,905,172 | B1 * | 6/2005 | Barnett | 297/344.18 X |
| D512,576 | S | 12/2005 | Szyperski et al. | |
| 8,303,032 | B1 * | 11/2012 | Platta | 297/45 X |
| 8,465,090 | B1 * | 6/2013 | O'Connor | 297/45 |
| 8,517,462 | B2 * | 8/2013 | Birch | 297/17 X |
| 2013/0026799 | A1 * | 1/2013 | Miller | 297/19 |

* cited by examiner

*Primary Examiner* — Rodney B White

(57) ABSTRACT

An inclined chair assembly includes a foldable seat that may support a user on an inclined support surface. A leg is coupled to the foldable seat so the leg may abut the inclined support surface. A support is coupled to the foldable seat so the support may support a user's arm.

4 Claims, 3 Drawing Sheets

INCLINED CHAIR ASSEMBLY

BACKGROUND OF THE DISCLOSURE

Field of the Disclosure

The disclosure relates to inclined chair devices and more particularly pertains to a new inclined chair device for sitting on an inclined support surface.

SUMMARY OF THE DISCLOSURE

An embodiment of the disclosure meets the needs presented above by generally comprising a foldable seat that may support a user on an inclined support surface. A leg is coupled to the foldable seat so the leg may abut the inclined support surface. A support is coupled to the foldable seat so the support may support a user's arm.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
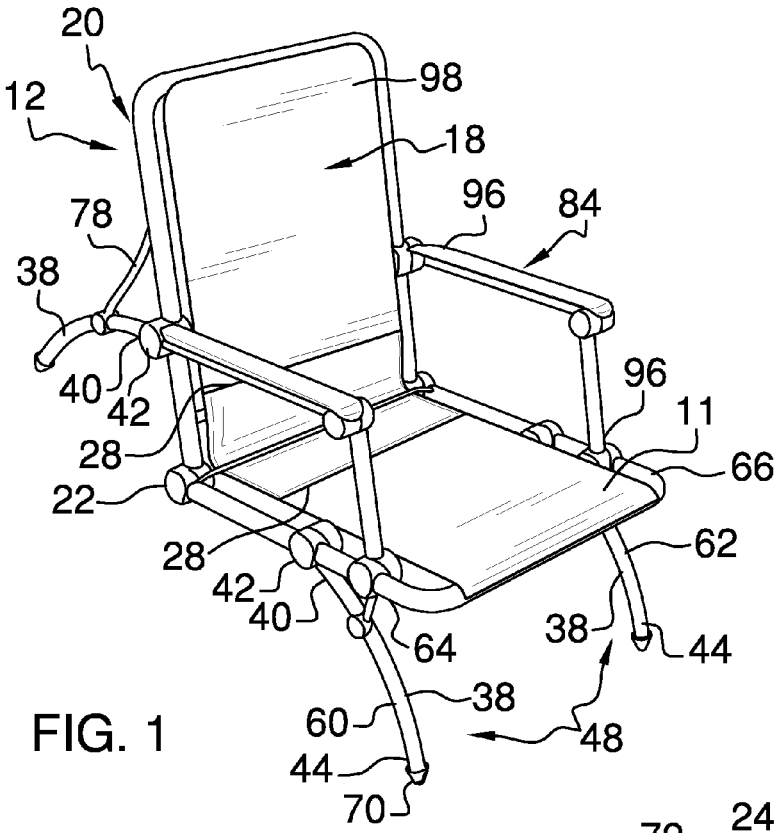
FIG. 1 is a front perspective view of an inclined chair assembly according to an embodiment of the disclosure.
Figure 2:
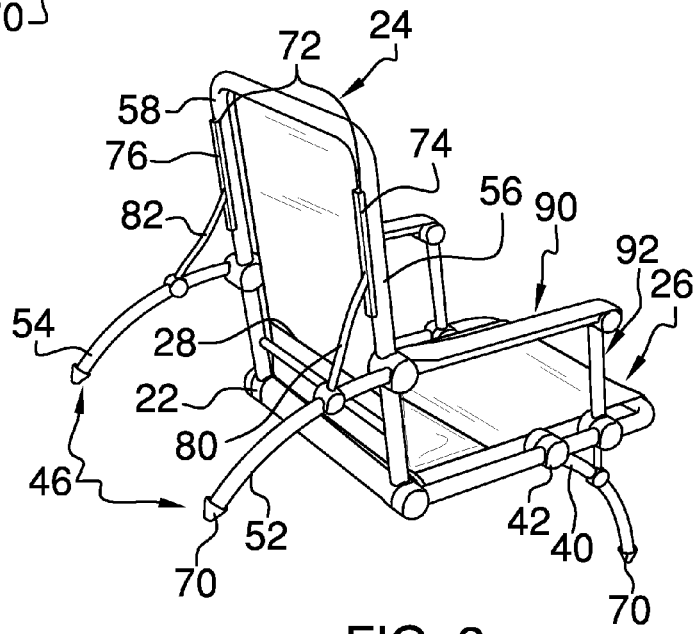
FIG. 2 is a back perspective view of an embodiment of the disclosure.
Figure 3:
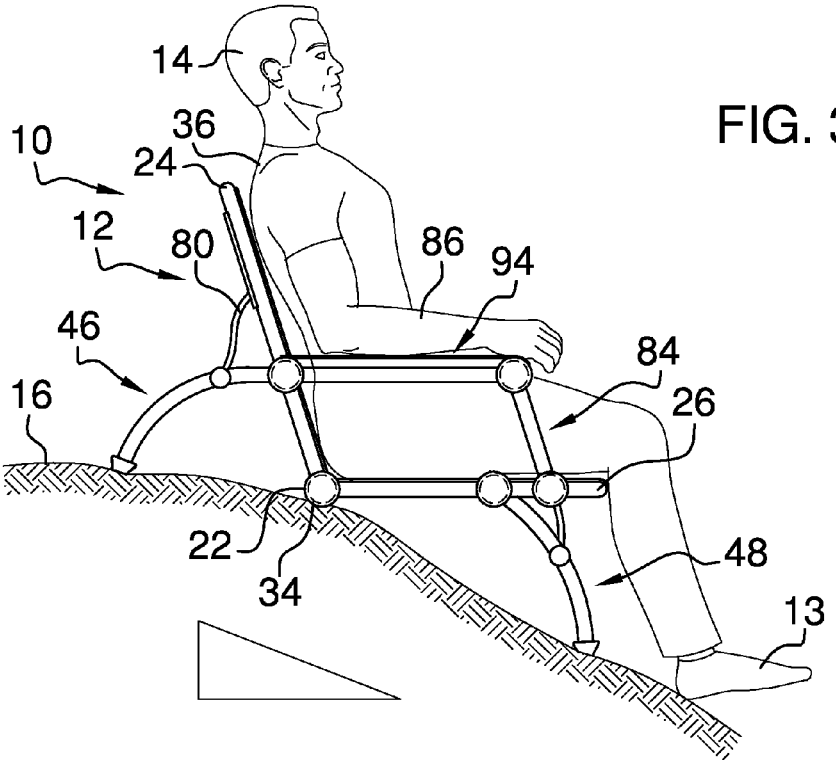
FIG. 3 is a right side view of an embodiment of the disclosure.
Figure 4:
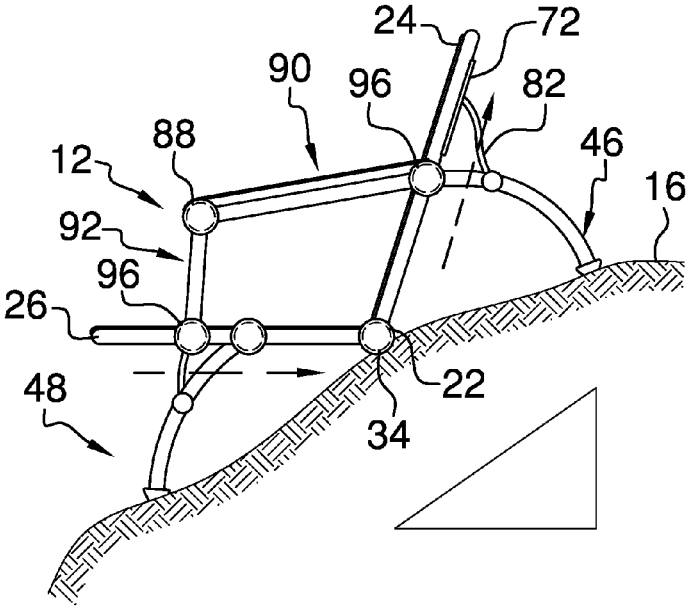
FIG. 4 is a left side view of an embodiment of the disclosure.
Figure 5:
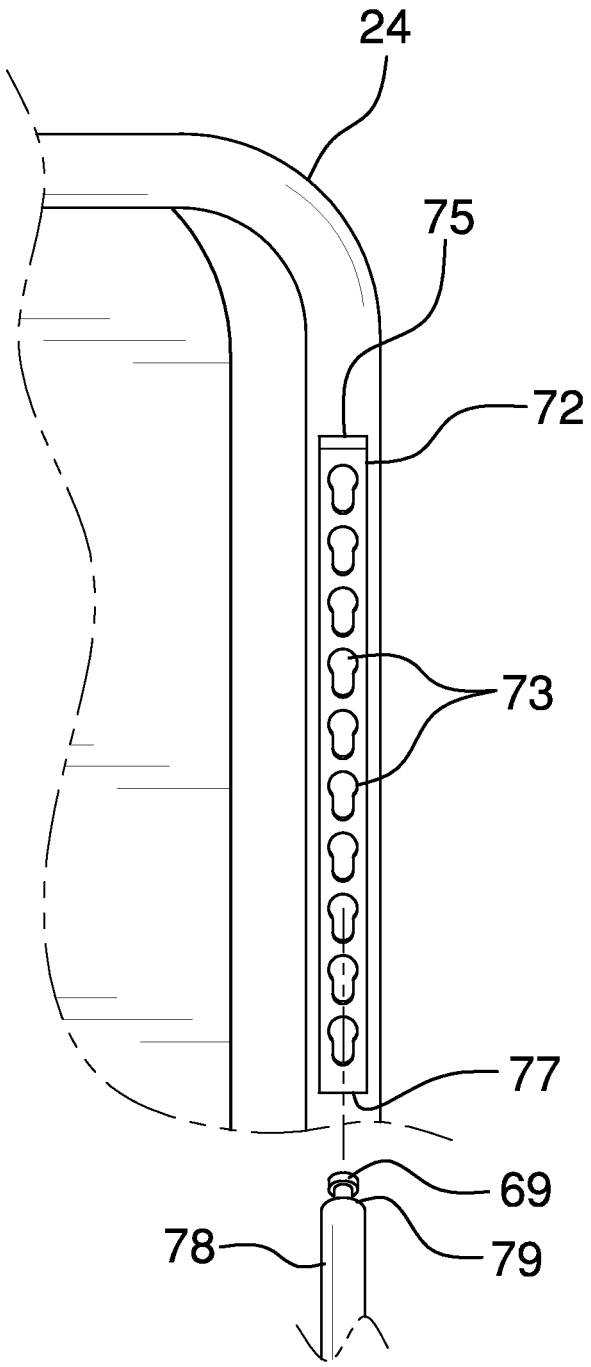
FIG. 5 is a back side view of an embodiment of the disclosure.

With reference now to the drawings, and in particular to FIGS. 1 through 5 thereof, a new inclined chair device embodying the principles and concepts of an embodiment of the disclosure and generally designated by the reference numeral 10 will be described.

As best illustrated in FIGS. 1 through 5, the inclined chair assembly 10 generally comprises a foldable seat 12 that may support a user 14 on an inclined support surface 16. The foldable seat 12 may comprise a fabric 18 coupled to and stretched across a tubular frame 20. A seat hinge 22 is coupled to the foldable seat 12. The seat hinge 22 defines a first section 24 of the foldable seat 12 hingedly coupled to a second section 26 of the foldable seat 12. The first section 24 of the foldable seat 12 may be positioned at a selected angle with respect to the second section 26 of the foldable seat 12. The selected angle may be an angle between 0° and 135°. A pair of pads 28 is each coupled to an associated one of the first 24 and second 26 sections of the foldable seat 12. Each of the pads 28 is positioned proximate the seat hinge 22. The pads 28 may each be comprised of a fluid impermeable material so the pads 28 may each protect the user 14 from moisture.

The foldable seat 12 is positionable on the inclined support surface 16 such that a bottom 34 of the seat hinge 22 abuts the inclined support surface 16. The user 14 may sit on the second section 26 of the foldable seat 12 so the user's 36 back abuts the first section 24 of the foldable seat 12 The second section 26 of the foldable seat 12 may have a length between 56 cm and 66 cm and a width between 56 cm and 66 cm. The first section 24 of the foldable seat 12 may have a length between 70 cm and 81 cm and a width between 56 cm and 66 cm.

A leg 38 is movably coupled to the foldable seat 12. A coupled end 40 of the leg 38 may comprise a leg hinge 42 coupled to the foldable seat 12 so the leg 38 is positionable at a selected angle with respect to the foldable seat 12. The leg 38 may be convexly arcuate from the coupled end 40 of the leg 38 to a bottom end 44 of the leg 38. The leg 38 may have a length between 28 cm and 33 cm. The leg 38 comprises a pair of sets. The pair of sets comprises a first set 46 hingedly coupled to the back 30 of the first section 24 of the foldable seat 12 and a second set 48 hingedly coupled to a bottom 50 of the second section 26 of the foldable seat 12.

The first set of legs 46 comprises a first leg 52 and a second leg 54 each positioned proximate an associated one of a first lateral edge 56 and a second lateral edge 58 of the first section 24 of the foldable seat 12. The second set of legs 48 comprises a first leg 60 and a second leg 62 each positioned proximate an associated one of a first lateral edge 64 and a second lateral edge 66 of the second section 26 of the foldable seat 12. The bottom end 44 of each of the first 46 and second 48 sets of legs abuts the inclined support surface 16 so the foldable chair 12 is retained on the inclined support surface 16. A foot 70 may be coupled to the bottom end 44 of each of the first 46 and second 48 sets of legs. The foot 70 may engage the inclined support surface 16 to prevent the foldable seat 12 from sliding downhill on the inclined support surface 16.

A bracket 72 is coupled to the back 30 of the first section 24 of the foldable seat 12. The bracket 72 may have a length between 10 cm and 15 cm. A plurality of arm apertures 73 extends through the bracket 72. The plurality of arm apertures 73 is evenly distributed between a top 75 and a bottom 77 of the bracket 72. The bracket 72 is one of a pair of brackets 72. A first 74 and a second 76 one of the pair of brackets 72 is each positioned proximate an associated one of the first 56 and second 58 lateral edges of the first section 24 of the foldable seat 12.

An arm 78 is movably coupled between the bracket 72 and the leg 38. A coupler 69 is coupled to a top end 79 of the arm 78. The coupler 69 is positionable within a selected one of the arm apertures 73 on the bracket 72 in order to position the leg 38 at the selected angle with respect to the foldable seat 12. The arm 78 may have an S-shape. The arm 78 is one of a pair of arms 78. The pair of arms 78 comprises a first arm 80 movably coupled between the first bracket 74 and the first leg 52 of the first set of legs 46 and a second arm 82 movably coupled between the second bracket 76 and the second leg 54 of the first set of legs 46.

A support 84 is coupled to the foldable seat 12 so the support 84 may support a user's arm 86. A support hinge 88 is coupled to the support 84. The support hinge 88 defines a first section 90 of the support 84 hingedly coupled to a second section 92 of the support 84. The user 14 may position the user's arm 86 on a top 94 of the first section 90 of the support 84. A free end 96 of each of the first 90 and second 92 sections of the support 84 is coupled to an associated one of a front side 98 of the first section 24 of the foldable chair 12 and a top side 11 of the second section 26 of the foldable chair 12. The support 84 is one of a pair of supports 84 each extending between an associated one of each of the first lateral edges 56, 64 and each of the second lateral edges 58, 66 of each of the first 24 and second 26 sections of the foldable chair 12.

In use, the foldable chair 12 may be positioned on the inclined support surface 16 so the second set of legs 48 is positioned downhill from the first set of legs 46. The legs 38 may be positioned at the selected angle with respect to the foldable seat 12 so the bottom 34 of the seat hinge 22 abuts the inclined support surface 16. The first 24 and second 26 sections of the foldable seat 12 may be positioned at the selected angle with respect to each other. The user 14 may sit on the second section 26 of the foldable seat 12 so each of the user's feet 13 is positioned downhill from the foldable seat 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to falling within the scope of the disclosure.

I claim:

1. An inclined chair assembly comprising:

a foldable seat configured to support a user on an inclined support surface, a seat hinge coupled to said foldable seat wherein said seat hinge defines a first section of said foldable seat hingedly coupled to a second section of said foldable seat, said first section defining a backrest and said second section defining a seat portion, said foldable seat being positionable on the inclined support surface;

a first set of legs being hingedly coupled to a back of said backrest, a second set of legs being hingedly coupled to a bottom of said seat portion, said first set of legs including a pair of legs each having a bottom end, said bottom ends of said first set of legs being positioned above a plain of said seat portion, wherein said first set of legs are positioned above said plane of said seat portion is horizontally oriented and said foldable seat is in a deployed position; and a pair of supports coupled to said foldable seat wherein said is said supports are configured to support a user's arm.

2. The assembly according to claim 1, further comprising a pair of brackets being attached to said back of said backrest, a pair of arms, each of said arms being movably coupled to said brackets, each of said arms being coupled to one of said legs of said first set of legs.

3. The assembly according to claim 1, further comprising wherein each of said supports includes a first section and a second section hingedly coupled together by a support hinge, said first section of each of said supports having an end coupled to a front side of a backrest of said foldable seat, said second section of each of said supports having an end coupled to a top side of a seat portion of said foldable seat.

4. An inclined chair assembly comprising:

a foldable seat configured to support a user on an inclined support surface;

a seat hinge coupled to said foldable seat wherein said seat hinge defines a first section of said foldable seat hingedly coupled to a second section of said foldable seat, said first section defining a backrest and said second section defining a seat portion, said foldable seat being positionable on the inclined support surface such that a bottom of said seat hinge abuts the inclined support surface;

a leg coupled to said foldable seat, said leg comprising a pair of sets, said pair of sets comprising a first set hingedly coupled to a back of said first section of said foldable seat and a second set hingedly coupled to a bottom of said second section of said foldable seat, said first set of legs comprising a first leg and a second leg each positioned proximate an associated one of a first lateral edge and a second lateral edge of said first section of said foldable seat, said second set of legs comprising a first leg and a second leg each positioned proximate an associated one of a first lateral edge and a second lateral edge of said second section of said foldable seat, a bottom end of each of said first and second sets of legs abutting the inclined surface wherein said foldable chair is retained on the inclined surface;

a bracket coupled to said back of said first section of said foldable seat, said bracket being one of a pair of said brackets, a first and a second one of said pair of brackets each being positioned proximate an associated one of said first and second lateral edges of said first section of said foldable seat;

an arm movably coupled between said bracket and said leg, said arm being one of a pair of said arms, said pair of arms comprising a first arm movably coupled between said first bracket and said first leg of said first set of legs and a second arm movably coupled between said second bracket and said second leg of said first set of legs;

a pair of supports each defining an arm support coupled to said foldable seat wherein said support is configured to support a user's arm.

* * * * *